US008161848B2

(12) United States Patent
Chen

(10) Patent No.: US 8,161,848 B2
(45) Date of Patent: Apr. 24, 2012

(54) SCREWDRIVER WITH CHANGEABLE HEAD

(75) Inventor: Cheng-Chi Chen, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 340 days.

(21) Appl. No.: 12/545,083

(22) Filed: Aug. 21, 2009

(65) Prior Publication Data

US 2010/0294091 A1 Nov. 25, 2010

(30) Foreign Application Priority Data

May 25, 2009 (CN) ..... 2009 1 0302598

(51) Int. Cl.
*B25B 23/00* (2006.01)

(52) U.S. Cl. ..... 81/438; 81/112; 279/37

(58) Field of Classification Search ..... 81/438, 81/439, 177.85; 279/35, 37, 38, 50
See application file for complete search history.

(56) References Cited

U.S. PATENT DOCUMENTS

| | | | | | |
|---|---|---|---|---|---|
| 203,581 | A * | 5/1878 | Birch | 81/112 |
| 211,992 | A * | 2/1879 | Gutmann | 81/112 |
| 282,605 | A * | 8/1883 | Birch | 81/112 |
| 414,804 | A * | 11/1889 | Franklin | 81/112 |
| 553,226 | A * | 1/1896 | Brockett | 279/35 |
| 587,464 | A * | 8/1897 | Swick et al. | 81/62 |
| 603,825 | A * | 5/1898 | Barber | 279/37 |
| 1,575,149 | A * | 3/1926 | Craig et al. | 81/455 |
| 2,240,556 | A * | 5/1941 | Eide | 81/111 |
| 2,509,306 | A * | 5/1950 | Litterio | 279/35 |
| 2,654,135 | A * | 10/1953 | Grizzard et al. | 24/635 |
| 2,942,897 | A * | 6/1960 | Eason | 403/317 |
| 3,599,996 | A * | 8/1971 | Holt | 279/37 |
| 3,881,763 | A * | 5/1975 | Benson | 294/116 |
| 3,900,058 | A * | 8/1975 | McArdle | 81/463 |
| 4,032,163 | A * | 6/1977 | Holt | 279/37 |
| 4,787,278 | A * | 11/1988 | Bononi | 81/438 |
| 4,934,717 | A * | 6/1990 | Budelman et al. | 279/79 |
| 5,044,421 | A * | 9/1991 | Tebbe | 164/401 |
| 5,528,963 | A * | 6/1996 | Wei | 81/63 |
| 5,964,132 | A * | 10/1999 | Chen | 81/439 |
| 6,155,144 | A * | 12/2000 | Lin | 81/438 |
| 6,578,457 | B2 * | 6/2003 | Eichhorn | 82/160 |
| 6,725,749 | B1 * | 4/2004 | Liou | 81/438 |
| 7,523,689 | B2 * | 4/2009 | Lin | 81/177.85 |
| 7,694,979 | B2 * | 4/2010 | Jokinen | 279/108 |
| 2006/0123957 | A1 * | 6/2006 | Hsien | 81/438 |
| 2009/0064827 | A1 * | 3/2009 | Chen | 81/438 |
| 2009/0165606 | A1 * | 7/2009 | Hsien | 81/438 |
| 2011/0083536 | A1 * | 4/2011 | Palmisano | 81/439 |

* cited by examiner

*Primary Examiner* — Debra S Meislin
(74) *Attorney, Agent, or Firm* — Altis Law Group, Inc.

(57) ABSTRACT

A screwdriver is convenient for changing driver heads. A button is released to drive an arm of the screwdriver in a first position to grasp a fixing portion of the driver head. The button is pressed to drive the arm to rotate from the first position to a second position to deform an elastic member, with the arm releasing the driver head to make the driver head drop out of the handle. Each of the driver head can be easily mounted to the screwdriver, and detached from the screwdriver.

7 Claims, 4 Drawing Sheets

SCREWDRIVER WITH CHANGEABLE HEAD

BACKGROUND

1. Technical Field

The present disclosure relates to screwdrivers, and particularly to a screwdriver with changeable driver head.

2. Description of Related Art

A conventional screwdriver is integrally formed with a specific driver head, which can be any of many types and sizes. Because types and sizes of screwdrivers are different from one another, a user usually needs to buy many screwdrivers to handle different tasks. It is quite inconvenient to store or carry these screwdrivers. Therefore, a screwdriver with replaceable driver heads sharing one handle was invented. However, to change driver heads, an operator needs to grasp the handle of the screwdriver with one hand, and change the head with the other hand, which can be extremely inconvenient because two hands are required.

DETAILED DESCRIPTION

Figure 1:
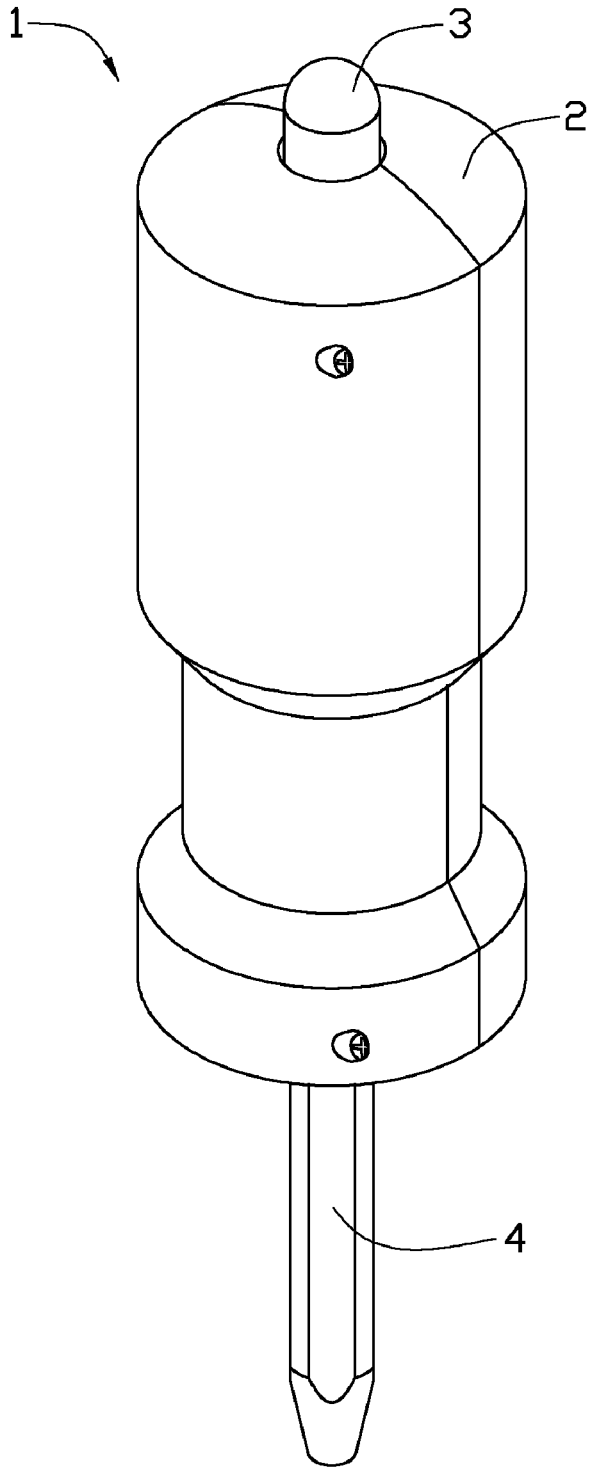
FIG. 1 is an isometric view of a first exemplary embodiment of a screwdriver.
Figure 2:
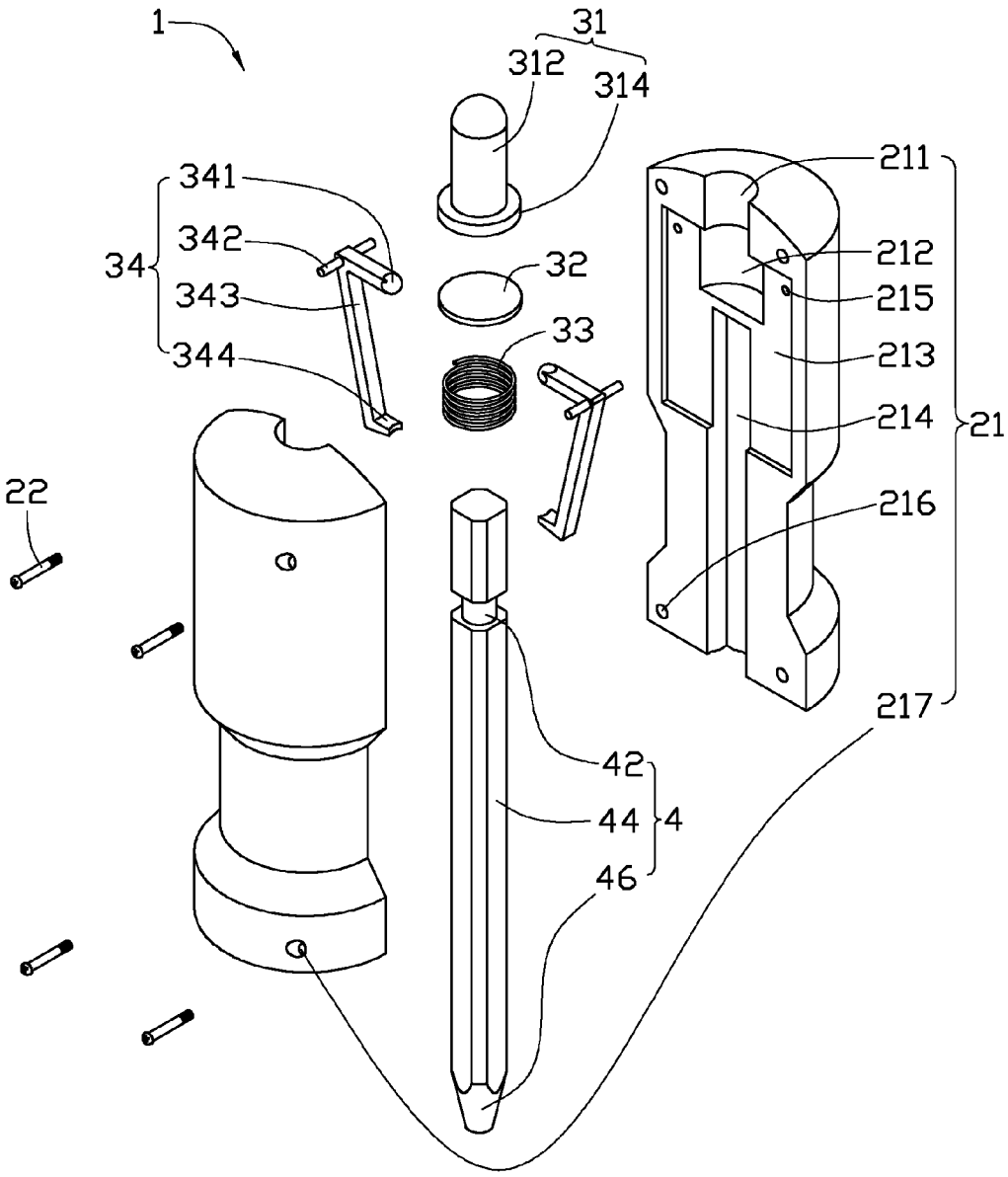
FIG. 2 is an exploded, isometric view of the screwdriver of FIG. 1.

Referring to FIGS. 1 and 2, a first exemplary embodiment of a screwdriver 1 includes a handle 2, a resisting portion 3, and a driver head 4 mounted to the handle 2.

The driver head 4 includes an elongated main body 44 with a substantially polygonal-shaped cross-section, a substantially annular-shaped fixing portion, such as a fitting groove 42 defined in a first end of the main body 44, and an operating portion 46 extending from a second end opposite to the first end of the main body 44. In other embodiments, the fixing portion may be a protrusion or another kind of structure.

The handle 2 includes two parts 21, and a plurality of fastening members 22 for mounting the two parts 21 together. Each part 21 has a substantially semi-circular cross-section, and includes a matching surface to match with the matching surface of the other part 21, and a curved surface connecting opposite sides of the matching surface. Four screw holes 216 are defined in one part 21 through the matching surface and the curved surface of the part 21, and four corresponding through holes 217 are defined in the other part 21 through the corresponding matching surface and curved surface. Each part 21 defines two substantially semicircular-shaped slots 211 and 212, and a slot 214 with a substantially polygonal-shaped cross-section in the matching surface and symmetrically around an axis of the part 21, extending from top to bottom of the part 21. A rectangular-shaped slot 213 is defined in the matching surface of the part 21, and the slot 212 and an upper part of the slot 214 are defined in a bottom of the slot 213. A radius of the slot 211 is less than a radius of the slot 212. Two holes 215 are defined in the bottom of the slot 213, at opposite sides of the slot 212.

The resisting portion 3 includes a button 31, a substantially coin-shaped resisting member 32, an elastic member such as a helical spring 33, and two arms 34. The button 31 includes a substantially cylindrical-shaped main body 312, a substantially annular-shaped protrusion 314 formed around a bottom end of the main body 312. A radius of the protrusion 314 is greater than the radius of the slot 211, and less than the radius of the slot 212. A diameter of the resisting member 32 is greater than a diameter of the spring 33. In one embodiment, the resisting member 32 may be made of wear-resistant material, such as alloy steel material. Each arm 34 includes a slanting connection pole 343, a stress portion 341 bent from a top end of the connection pole 343, and a clasp 344 bent from a bottom end of the connection pole 343, the clasp 344 substantially parallel to the stress portion 341. Two shafts 342 extend from opposite sides of a junction between the connection pole 343 and the stress portion 341.

Figure 3:
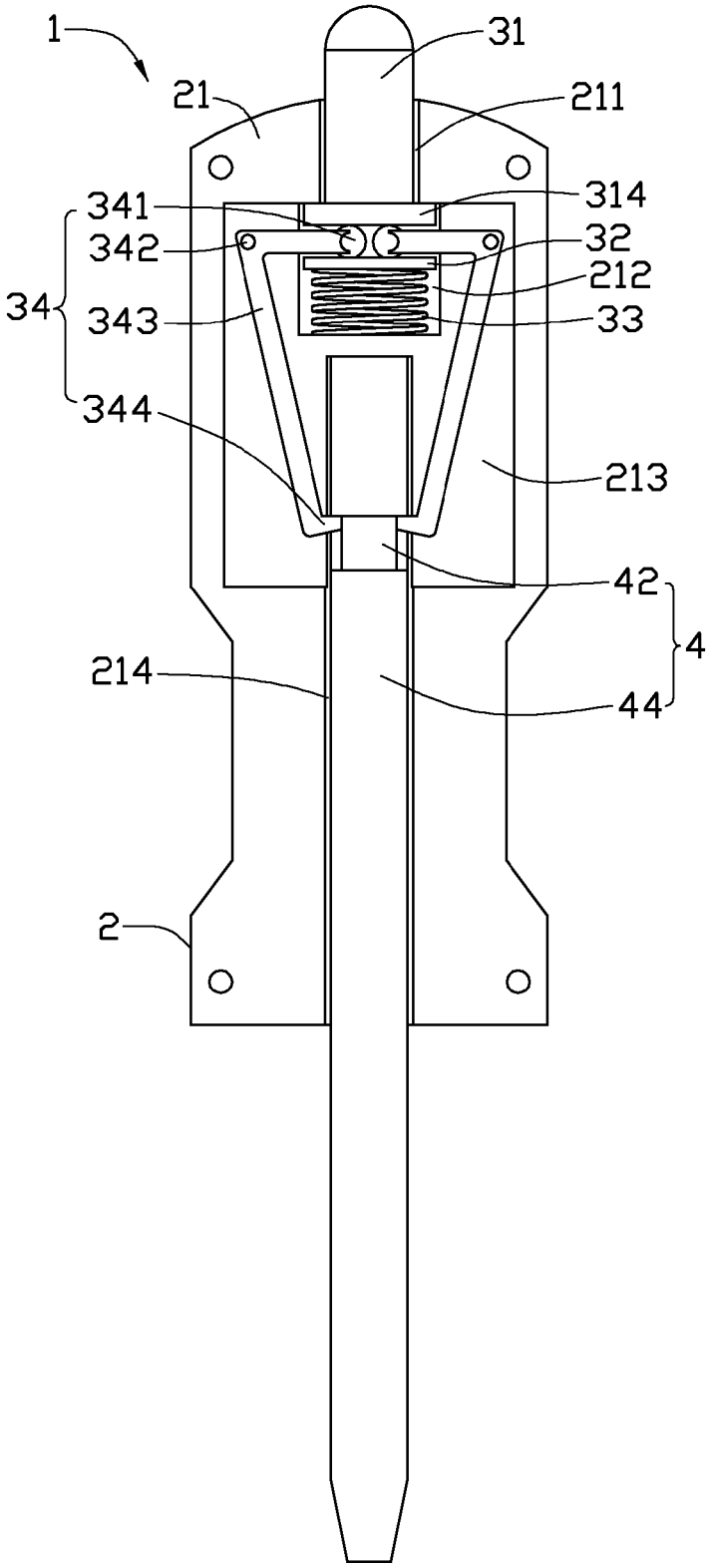
FIG. 3 is a schematic diagram, showing inner parts of the screwdriver of FIG. 1.

Referring to FIG. 3, in assembly, the button 31 of the main body 312 is received in the slot 211 of a first part 21, with the protrusion 314 being received in the slot 212 of the first part 21 and resisting against a top end of the slot 212. A top end opposite to the protrusion 314 of the button 31 extends out through the slot 211. Each arm 34 is received in the slot 214 of the first part 21, with one shaft 342 of the arm 34 inserted into a corresponding hole 215 of the first part 21. The spring 33 is received in the slot 212 and below the stress portion 341 of the arm 34, with a bottom end of the spring 33 resisting against a bottom end of the slot 212. The resisting member 32 is mounted between a top end of the spring 33 and the stress portions 341 of the arms 34. The two parts 21 are attached, with the matching surfaces of the two parts 21 matching with each other, the corresponding shafts 342 of the arms 34 received in the corresponding holes 215 of the second part 21, and the through holes 217 of the second part 21 aligning with the corresponding screw holes 216 of the first part 21. The fastening members 22 extend through the corresponding through holes 217, to engage in the corresponding screw holes 216, thereby fixing the two parts 21 together to form the handle 2.

In use, an operator holds the screwdriver 1 in one hand and presses the button 31 of the main body 312, with the protrusion 314 of the button 31 pressing the stress portions 341 of the arms 34 down. The resisting member 32 compresses the spring 33, and the arms 34 rotate around the corresponding shafts 342 to make the clasps 344 of the arms depart from each other. Then, while still only needing to use one hand, the operator can fit the slot 214 over a driver head 4 and release the button 31. The spring 33 then restores and the arms 34 rotate back, with the clasps 344 moving towards each other to sandwich the driver head 4 at the fitting groove 42 of the driver head 4. Therefore, the screwdriver 1 is assembled with a driver head 4.

When the driver head 4 needs to be detached from the screwdriver 1, the screwdriver 1 is kept vertical. The button 31 is pressed, the stress portion 341 pushes the resisting member 32 to compress the spring 33. The arms 34 rotate around the shaft 342, and the clasps 344 depart from each other to release the driver head 4. The driver head 4 overcomes friction between a wall bounding the slot 214 and the driver head 4, to drop from the handle 2 automatically, because of gravity, and then another driver head 4 may be installed as above.

When a new driver head 4 needs to be mounted on the screwdriver 1, the button 31 is pressed to rotate the arms 34, with the clasps 344 departing from each other. The new driver head 4 which is kept vertical in a toolbox is inserted into the slot 214 of the handle 2. The button 31 is released, and the spring 33 restores to rotate the arms 34 back. The clasps 344 move towards each other to clasp the driver head 4 at the fitting groove 42.

Figure 4:
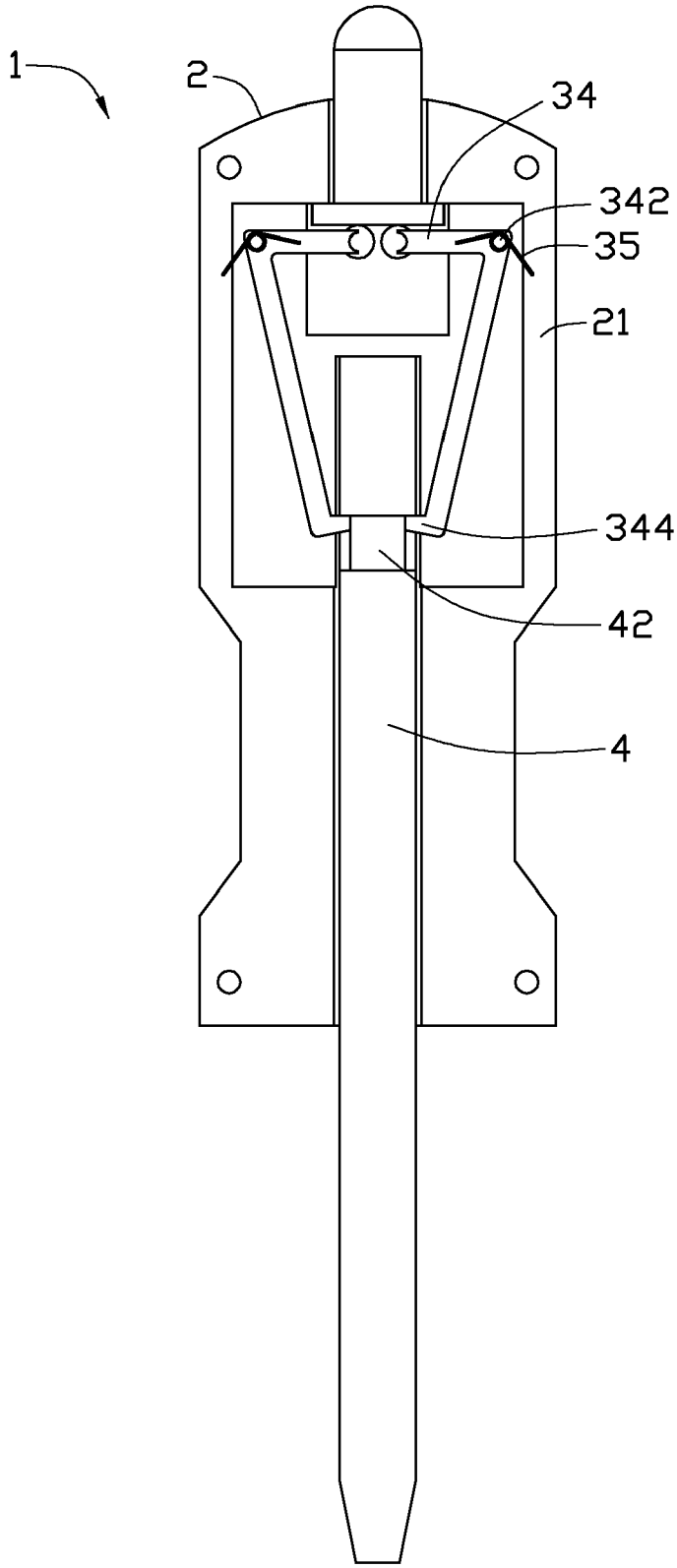
FIG. 4 is a schematic diagram showing inner parts of a second exemplary embodiment of a screwdriver.

FIG. 4 discloses a second exemplary embodiment of a screwdriver 1. A difference between the first and the second exemplary embodiments of the screwdrivers 1 is that the second exemplary embodiment of the screwdriver 1 does not include a resisting member 32 and the spring 33, while includes a torsion spring 35 connected between each arm 34 and the handle 2. The torsion springs 35 provide a power to drive the clasps 344 of the arms 34 to clasp the driver head 4 firmly.

It is to be understood, however, that even though numerous characteristics and advantages of the embodiments have been set forth in the foregoing description, together with details of the structure and function of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A screwdriver comprising:

a driver head comprising a fixing portion;

a handle defining a first slot in a lower part of the handle for receiving the driver head, a second slot in an upper portion of the handle, and a third slot defined in the handle and communicating with an upper part of the first slot and with the second slot; and a resisting portion received in the second slot and comprising:

at least one arm each comprising a slanting connecting pole and a stress portion bent from a top end of the slanting connecting pole; the top end of the slanting connecting pole rotatably mounted to a connecting hole defined on a bottom of the third slot, and the arm capable of rotating around the connecting hole to a first position to grasp the fixing portion of the driver head by the slanting connecting pole when the stress portion being pushed upwardly, or rotating to a second position to release the fixing portion of the driver head when the stress portion being pushed downwardly;

at least one elastic member capable of abutting the stress portion and pushing the stress portion upwardly; and a button protruding out of the handle through the second slot, the button operable to abut against the stress portion and pushing the stress portion downwardly.

2. The screwdriver of claim 1, wherein the elastic member is a helical spring restricted between a bottom surface of the stress portion and a bottom end of a periphery of the second slot.

3. The screwdriver of claim 2, wherein the resisting portion further comprises a resisting member mounted between the helical spring and the arm.

4. The screwdriver of claim 1, wherein each of the arm comprises a clasp at a bottom of the slanting connecting pole, the fixing portion of the driver head is a fitting groove defined in the driver head opposite to the bottom, to match with the clasp.

5. The screwdriver of claim 1, wherein the elastic member is a torsion spring connected between the arm and the handle.

6. The screwdriver of claim 1, wherein the at least one arm comprises two arms, and the two arms are separately mounted to the third slot.

7. The screwdriver of claim 1, wherein a shaft extends from the top end of the slanting connecting pole to rotatably mount the arm to the third slot.

* * * * *